US005230314A

United States Patent [19]

Kawahara et al.

[11] Patent Number: 5,230,314

[45] Date of Patent: Jul. 27, 1993

[54] 4-CYCLE ENGINE

[75] Inventors: Yoshitaka Kawahara; Masaaki Nakachi; Yoshihide Nakatani, all of Nagoya, Japan

[73] Assignee: Mitsubishi Jukogyo Kabushiki Kaisha, Tokyo, Japan

[21] Appl. No.: 901,579

[22] Filed: Jun. 19, 1992

[30] Foreign Application Priority Data

| | | | |
|---|---|---|---|
| Jun. 20, 1991 | [JP] | Japan | 3-174812 |
| Feb. 4, 1992 | [JP] | Japan | 4-048030 |
| Mar. 11, 1992 | [JP] | Japan | 4-086631 |
| Apr. 1, 1992 | [JP] | Japan | 4-105216 |

[51] Int. Cl.[5] ..... F01L 7/00

[52] U.S. Cl. ..... 123/317; 123/318; 123/80 BA

[58] Field of Search ..... 123/317, 80 BA, 318, 123/73 A, 21, 190.8, 190.17

[56] References Cited

U.S. PATENT DOCUMENTS

| | | | |
|---|---|---|---|
| 1,825,959 | 10/1931 | Kondo | 123/317 |
| 3,756,206 | 9/1973 | Gommel | 123/317 |
| 3,945,364 | 3/1976 | Cook | 123/190.8 |
| 3,973,532 | 8/1976 | Litz | 123/317 |
| 4,114,639 | 9/1978 | Cross | 123/190.17 |
| 4,116,189 | 9/1978 | Asaga | 123/80 BA |
| 4,169,434 | 10/1979 | Guenther | 123/317 |
| 4,473,041 | 9/1984 | Lyons et al. | 123/190.17 |
| 4,475,499 | 10/1984 | Sheaffer | 123/317 |
| 4,558,671 | 12/1985 | Stinebaugh | 123/317 |
| 4,715,336 | 12/1987 | Schindler et al. | 123/318 |
| 4,794,895 | 1/1989 | Kruger | 123/190.17 |

FOREIGN PATENT DOCUMENTS

| | | | |
|---|---|---|---|
| 2741649 | 3/1979 | Fed. Rep. of Germany | 123/317 |
| 2467288 | 5/1981 | France | 123/80 BA |
| 47-35516 | 11/1972 | Japan . | |
| 61-200330 | 9/1986 | Japan . | |
| 0642143 | 3/1984 | Switzerland | 123/80 BA |

*Primary Examiner*—E. Rollins Cross
*Assistant Examiner*—Erick Solis
*Attorney, Agent, or Firm*—Wenderoth, Lind & Ponack

[57] ABSTRACT

A 4-cycle internal combustion engine including a crankcase, a cylinder, a cylinder head, a piston adapted to reciprocate within the cylinder, a combustion chamber formed by the piston, the cylinder and the cylinder head, and a crankshaft connected to the piston via a connecting rod, is improved in order to enhance its thermal efficiency, to reduce exhaust emissions and to make it possible to operate the engine while the engine is in any attitude. The improvements reside in an intake passage and an exhaust passage provided in the cylinder head, a rotary valve rotating synchronously with the crankshaft at a speed one-half of that of the latter for placing the intake passage and the exhaust passage in communication with the cylinder during an intake stroke and an exhaust stroke of the piston, respectively, a check valve through which the intake passage communicates with the interior of the crankcase so that only flow is allowed from the crankcase towards the intake passage, and a carburetor device for feeding a fuel mixture of air, fuel and lubricant oil into the crankcase. The suction of the fuel mixture into the crankcase chamber as well as the feeding of the fuel mixture within the crankcase to the intake passage are made possible by the variation in pressure within the crankcase chamber caused by the reciprocation of the piston.

12 Claims, 8 Drawing Sheets 1510
25
1511
26
22

4-CYCLE ENGINE

BACKGROUND OF THE INVENTION

1. Field of the Invention

The present invention relates to a 4-cycle engine which produces an exhaust having a relatively low amount of hydrocarbons, carbon monoxide, or the like.

2. Description of the Prior Art

One example of a 4-cycle engine in the prior art will be described with reference to FIG. 9 which is a cross-sectional view of a known 4-cycle internal combustion engine.

In this figure, reference numeral 1 designates a cylinder, numeral 2 designates a crankcase, numeral 3 designates a cylinder head, number 4 designates a piston, numeral 5 designates a crankshaft, numeral 6 designates a connecting rod, numeral 33 designates a cam shaft, numeral 37 designates an intake valve (an exhaust valve also has a similar configuration), and numeral 16 designates an ignition plug. Because these members are all principal parts of an internal combustion engine and well known, a further description thereof will be omitted. Reference numeral 40 designates lubricant oil which is reserved within the crankcase 8. Reference numeral 41 designates an oil dipper which is provided at a larger end portion of the connecting rod 6. When the piston 4 is proximate the bottom dead point, the oil dipper 41 contacts the lubricant oil 40. Reference numeral 7 designates a combustion chamber which is provided by a recess in the cylinder head 3 and is bounded by the cylinder 1 and piston 4. Reference numeral 34 designates a tappet, numeral 35 designates a push rod, and numeral 36 designates a rocker arm, which form a well-known valve moving mechanism jointly with the cam shaft 33 for opening and closing the intake valve 37 and an exhaust valve (not shown).

In operation, movement of the piston 4 opens the intake valve 37 via the cam shaft 33, the tappet 34, the push rod 35 and the rocker arm 36 and fresh gas is drawn into the cylinder 1. After the compression, ignition-combustion and expansion strokes have been carried out in a well-known manner, the exhaust valve (not shown) is opened to facilitate the discharge of exhaust, and one period is finished. As a result of vertical movement and rocking motion of the connecting rod 6, the oil dipper 41 splashes the oil 40 into the crankcase 8, and hence portions of the engine in sliding and rotary engagement are lubricated by the splashed oil. In another type of engine, in which an oil dipper is not employed, a lubricant oil pump is provided to circulate the lubricant oil reserved in the crankcase.

However, in the case of the above-described 4-cycle engines in the prior art, the orientation of the engines is limited due to the fact that lubricant oil is to be reserved at the bottom portion of the crankcase. That is, if the engine were to be operated while being tilted extremely, an oil dipper could not reach the lubricant oil, and hence there could be no distribution of lubricant oil. On the contrary, if the oil surface is too high relative to the oil dipper, a large amount of lubricant oil will be consumed due to excessive splashing. Accordingly, a 4-cycle engine cannot be used in a hand-held machine such as a hedge cutter, a chain saw or the like. The engines used for these applications are strictly 2-cycle engines. However, in view of thermal efficiency and exhaust gas, 2-cycle engines have many shortcomings. For instance, the amount of hydrocarbons in the exhaust of a 2-cycle engine is more than 10 times that of a 4-cycle engine.

SUMMARY OF THE INVENTION

It is therefore one object of the present invention to provide an engine in which the above-described disadvantages are eliminated, which can be operated while oriented at any attitude, and which is advantageous in terms of its thermal efficiency and the nature of the exhaust gas produced thereby.

According to the present invention, there is provided a 4-cycle internal combustion engine including a crankcase, a cylinder, a cylinder head, a piston adapted to reciprocate within the cylinder, a combustion chamber formed by the piston, the cylinder and the cylinder head, and a crankshaft connected to the piston via a connecting rod, wherein the improvement comprises an intake passage and an exhaust passage provided in the cylinder head, a rotary valve rotating synchronously with the crankshaft at a speed one-half of that of the latter for placing the intake passage and the exhaust passage in communication with the cylinder during an intake stroke and exhaust stroke, respectively, a check valve placing the intake passage in communication with a crankcase chamber and allowing only flow towards the intake passage, and fuel feed means for feeding a fuel mixture of air, fuel and lubricant oil into the crankcase chamber. The fuel mixture is aspirated into the crankcase chamber and the fuel mixture within the crankcase chamber is forced into the intake passage by the pressure within the crankcase chamber created by the reciprocating piston.

According to the present invention, during an intake stroke, the rotary valve opens the intake passage to the cylinder. Hence, the fuel mixture within the crankcase passages through the check valve and the intake passage, then through the rotary valve while lubricating the valve with drops of the lubricant oil contained in the fuel mixture, and then is drawn into the cylinder. When the intake stroke has ended, the rotary valve closes the passage between the cylinder and the intake passage. When the fuel mixture within the cylinder is compressed during the next stroke, the fuel mixture fed by the fuel feed means is simultaneously aspirated into the crankcase. The fuel mixture is ignited by a spark plug and burns near the end of the compression stroke. During the expansion stroke, a torque is applied to a crankshaft via a connecting rod, and the engine outputs power. Simultaneously, the fuel mixture within the crankcase is fed to the intake passage but it does not enter the cylinder. Near the bottom dead point of the piston, the rotary valve opens the cylinder to the exhaust passage, and so combustion gas is exhausted through the rotary valve to the exhaust passage. At this moment, fuel mixture fed by the fuel feed means is simultaneously drawn into the crankcase. When the exhausting of the combustion gas has ended, one period has been completed.

The above-mentioned and other objects, features and advantages of the present invention will become more apparent by referring to the following description of preferred embodiments of the invention taken in conjunction with the accompanying drawings.

DETAILED DESCRIPTION OF THE PREFERRED EMBODIMENTS

Now one preferred embodiment of the present invention will be described with reference to FIGS. 1 and 2.

Figure 1:
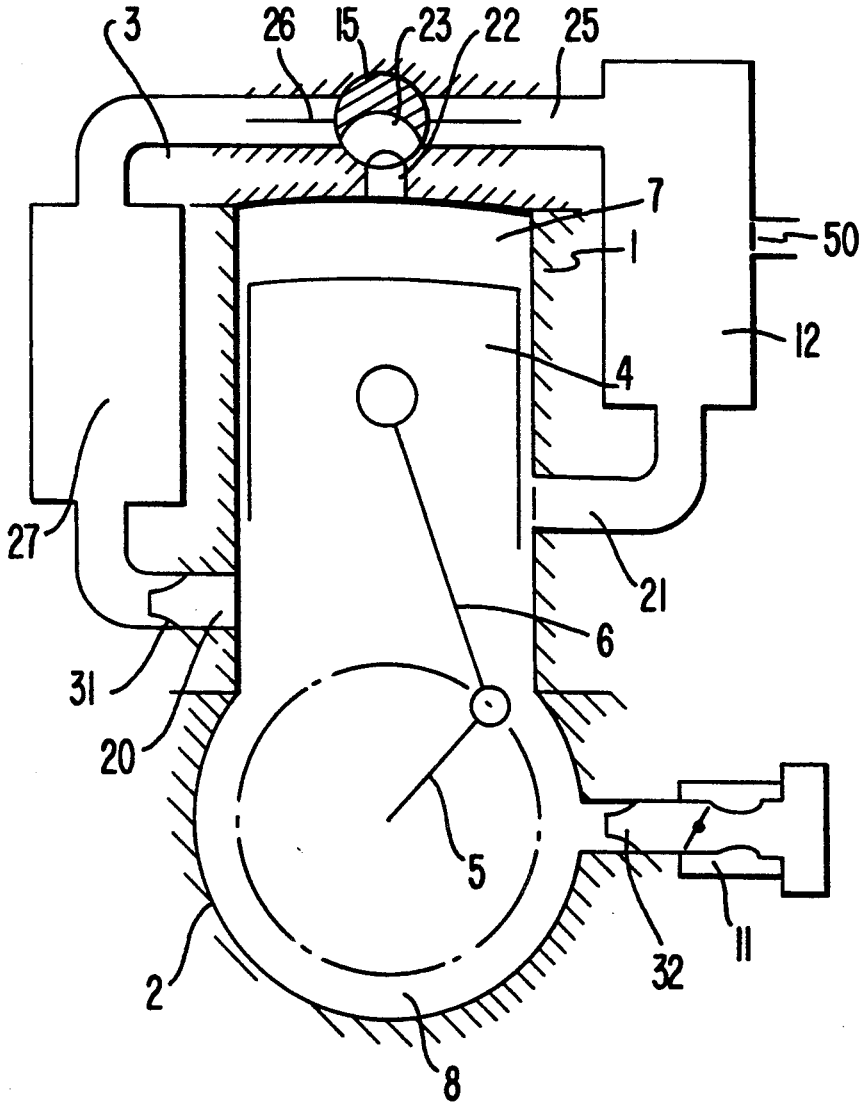
FIG. 1 is a schematic view of one embodiment of a 4-cycle engine according to the present invention.

In FIG. 1, reference numeral 1 designates a cylinder, numeral 2 designates a crankcase, numeral 3 designates a cylinder head, numeral 4 designates a piston, numeral 5 designates a crankshaft, numeral 6 designates a connecting rod, numeral 7 designates a combustion chamber, and numeral 12 designates a muffler. Because these members are all well-known parts of an internal combustion engine, a further description thereof will be omitted. Reference numeral 8 designates a crankcase chamber which has a small inner volume. Reference numeral 11 designates a carburetor which is connected to the crankcase 2 in communication with the crankcase chamber 8. Reference numeral 32 designates a reed valve which is provided in a section of the carburetor 11 connected with the crankcase chamber 8, and is adapted to direct air only towards the crankcase chamber. Reference numeral 15 designates a rotary valve which is provided in the cylinder head 3, and which is mechanically coupled to the crankshaft 5 so as to be rotated at a speed one-half of that of the crankshaft 5. Reference numeral 22 designates a communication passage which is provided in the cylinder head 3 to place the cylinder 1 in communication with the rotary valve 15. Reference numeral 25 designates an exhaust passage which is provided in the cylinder head 3 to place the rotary valve 15 in communication with the muffler 12. Reference numeral 27 designates an intake chamber in which intake gas is reserved, and which is connected to a lower portion of the cylinder 1.

Reference numeral 31 designates a reed valve which is provided at a portion of the intake chamber 27 connected with the lower portion of the cylinder, and which allows only flow towards the intake chamber 27. Reference numeral 26 designates an intake passage which is provided in the cylinder head 3, and which places the intake chamber 27 in communication with the rotary valve 15. Reference numeral 23 designates a rotary port which is provided in the rotary valve 15, and which selectively opens the communication passage 22 to the intake passage 26 or the exhaust passage 25 depending upon the position of the rotary valve 15. Reference numeral 20 designates an intake port which is open to the intake chamber 27 and the crankcase chamber 8, and which is provided between the crankcase chamber 8 and the reed valve 31. Although the cylinder intake port 20 is provided at the lower portion of the cylinder as viewed in FIG. 1, it is also possible to provide the cylinder intake port 20 directly in the crankcase 1.

Reference numeral 21 designates a cylinder exhaust port which is a bore extending through the cylinder wall a little above the bottom dead point of the piston, and which communicates with the aforementioned muffler 12. Reference numeral 50 designates a tail pipe placing the muffler 12 in communication with the atmosphere.

Now the operation of the above-described preferred embodiment will be described.

Figure 2:
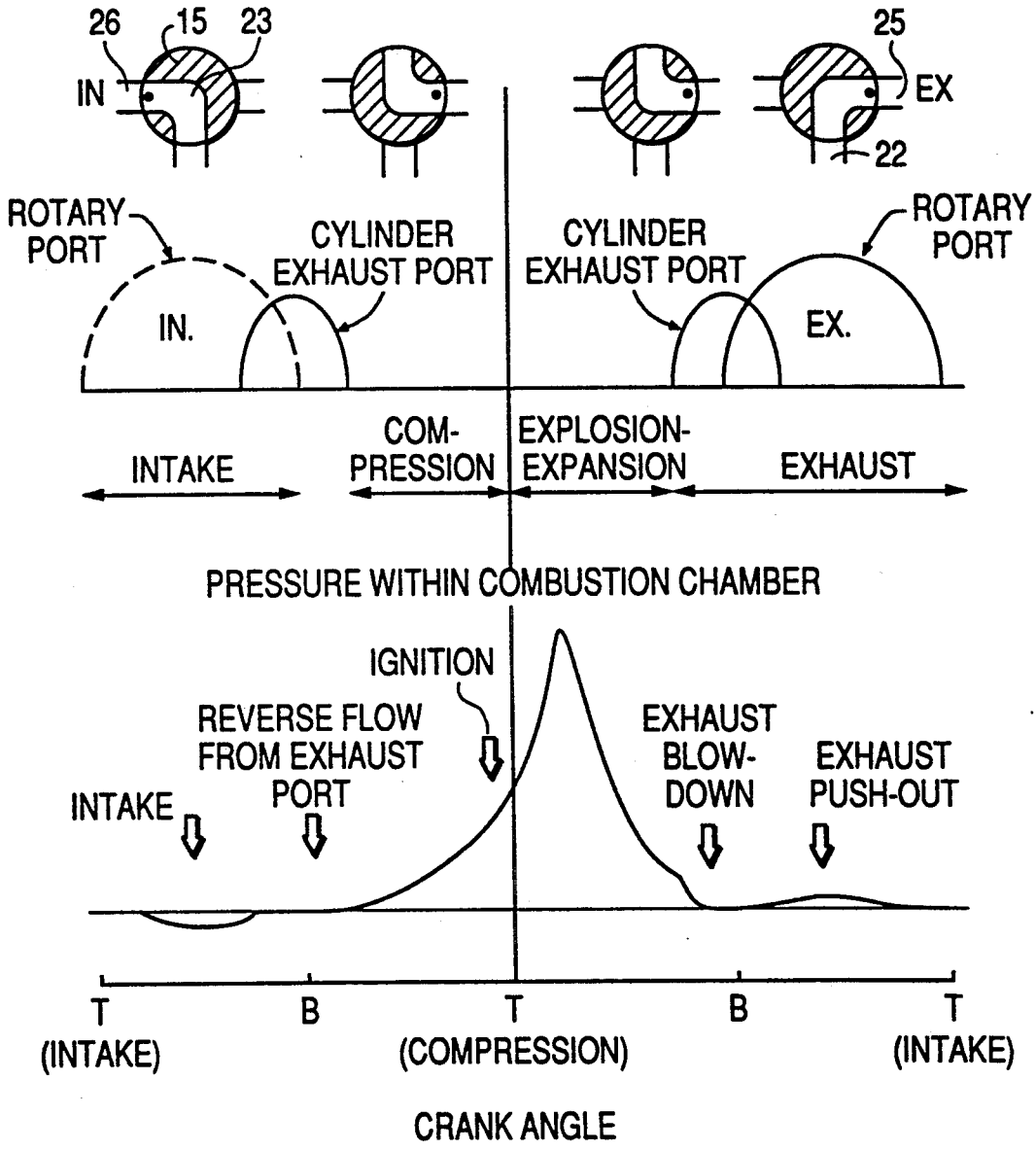
FIG. 2 is a diagram illustrating what occurs during the successive strokes of the illustrated embodiment of the present invention.

Referring to FIG. 2, the operation of the engine will be described. In FIG. 2, the crank angle is defined by the abscissa, whereas the position of the rotary valve, the degree of opening of the ports, and the pressure in the combustion chamber are plotted along the ordinate. At the top dead point of the piston, the rotary valve 15 begins to open the communication passage 22 to the intake passage 26 and an intake operation starts. When this intake operation is completed, the cylinder exhaust port 21 is opened by the piston just before the piston reaches the bottom dead point, and at this moment, exhaust gas flows reversely from the muffler 12 into the cylinder 1. At the time of a heavy load, the amount of reverse flow is small because the intake is large and a negative pressure in the cylinder is small at the bottom dead point of the piston during the intake stroke. At the bottom dead point of the intake stroke, the aforementioned rotary valve 15 closes the communication passage 22. The piston 4 closes the cylinder exhaust port 21 as compression commences. Just before the top dead point of the piston during the compression stroke, ignition is effected by means of an ignition plug (not shown), and the fuel mixture burns. When the piston 4 moves past the top dead point, an expansion stroke is initiated in which torque is generated on the crankshaft. Just before the bottom dead point of the piston 4, the cylinder exhaust port 2 is opened by the piston 4, and combustion gas blows down through the cylinder exhaust port 21 and flows out to the muffler 12.

At the bottom dead point of the piston during the expansion stroke, the rotary port 23 places the communication passage 22 in communication with the exhaust passage 25. The piston 4 rises during an exhaust stroke in which the cylinder exhaust port 21 is closed by the piston 4, and the combustion gas after blow-down is exhausted through the communication passage 22, the rotary port 23 and the exhaust passage 25 to the muffler 12. Because the gas passes through the rotary port 23 after blow-down, its pressure and temperature are both low. Also, only a small amount of this gas exists. The gas exhausted to the muffler 12 flows out to the atmosphere through the tail pipe 50. Then the piston arrives at the top dead point of its intake stroke. As the piston 4 descends from the top dead point of its intake stroke, the volume of the crankcase 1 is reduced. Hence, the pressure rises and the gas cannot flow through the reed valve. When the pressure within the crankcase becomes higher than the pressure in the intake chamber 27, the reed valve 31 is opened and the gas is forced into the intake chamber 27. When the piston has passed the bottom dead point of its intake stroke and begins the compression stroke, the volume of the crankcase 1 becomes large. Hence, the pressure lowers and the gas cannot flow through the reed valve 31. However, because the reed valve 32 is open, atmospheric air passes through the carburetor 11 to mix with fuel and lubricant oil, resulting in a fuel mixture which flows into the crankcase chamber 8.

At this top dead point, the fuel mixture is ignited and burns, and the expansion stroke begins. When the piston descends, similarly to the above-described intake stroke, the volume of the crankcase chamber 8 is reduced, the reed valve 32 is closed, and if the pressure of the fuel mixture within the crankcase chamber 8 becomes higher than the pressure in the intake chamber 27, the fuel mixture opens the reed valve 31 and flows into the intake chamber 27. Although the intake of the fuel mixture into the intake chamber would be effected twice during one period of the engine as described above, because of the fact that a pressure difference is necessary to open and close the reed valve, if the pressure in the intake chamber becomes high enough, the intake gas cannot enter the intake chamber, and so the amount of fuel mixture entering the intake chamber the second time during the period is negligible. Even if intake gas of a volume larger than the stroke volume of the piston were forced into the cylinder, at the end of the intake stroke it would blow through the cylinder exhaust port 21 to the muffler, and would not be used in the generation of power output. Next, the piston 4 moves upwards in an exhaust stroke. The volume of the crankcase chamber increases, and similar to the above-described operation, the piston 4 draws in fuel mixture from the carburetor 11, by generating suction to open the reed valve 32, until the piston reaches the top dead point. At this point, one period of the engine is completed. After all, an ideal intake is one in which when a throttle is 100% open, the amount of fuel intake within the cylinder corresponds to the piston stroke. Various parameters of the carburetor 11, the crankcase chamber 8, the reed valves 31 and 32, the intake chamber 27 and the rotary valves 15 are preset so as to realize such an intake.

As described above, according to the present invention, by employing a crankcase compression system in which lubricant oil is not reserved at the bottom of the crankcase chamber, a 4-cycle engine may operate while oriented at any attitude. Moreover, because gas within the cylinder is replenished in the respective intake and exhaust strokes of the 4-cycle engine, fresh intake gas will not directly blow to exhaust gas. In addition, even though the fuel mixture is formed by a carburetor, the blow-through of fuel mixture does not take place. Thus, the problem of a high exhaust level of fuel, which is a major drawback in the 2-cycle engine in the prior art, is resolved. Furthermore, since the exhaust port provided at the lower portion of the cylinder can exhaust combustion gas at a high temperature and a high pressure in a short period of time, a thermal load on the rotary valve portion is suppressed so as to sustain its durability.

Therefore, the 4-cycle engine of the present invention is advantageous in terms of its thermal efficiency and nature of its exhaust gas produced, and yet can be operated while oriented at any attitude.

Figure 3:
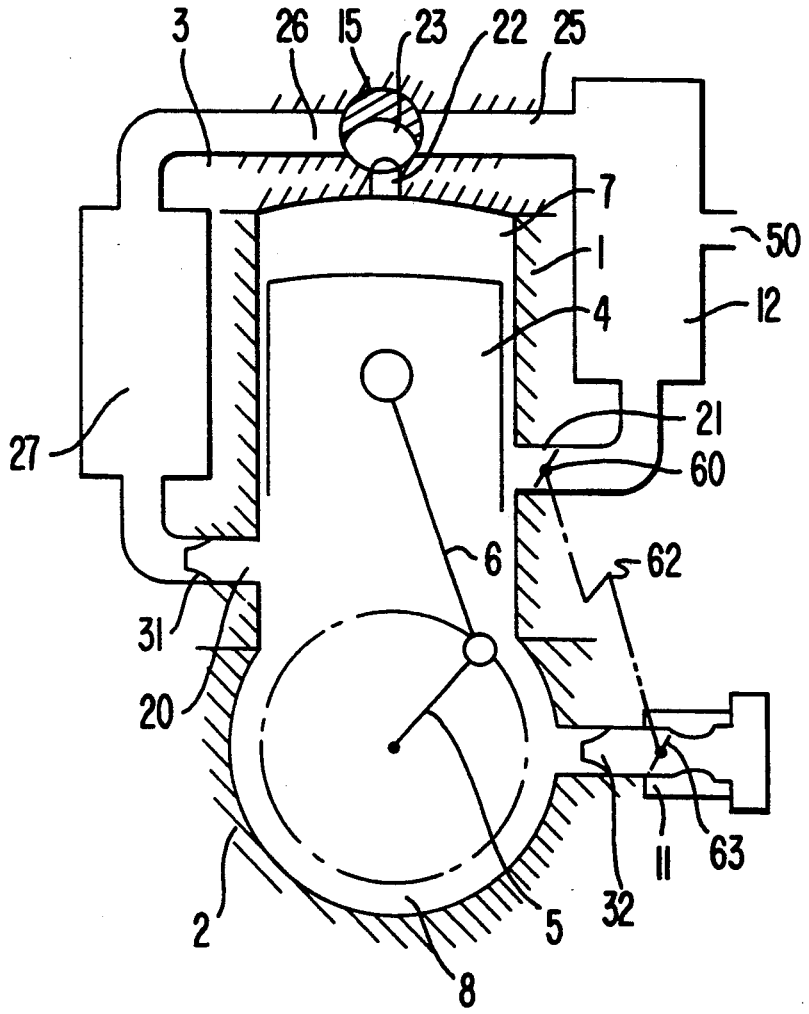
FIG. 3 is a schematic view of another embodiment of a 4-cycle engine according to the present invention.

It is to be noted that as one modification of the preferred embodiment shown in FIG. 1, an exhaust throttle valve 60 can be provided in the cylinder exhaust port 21 as shown in FIG. 3. This exhaust throttle valve 60 is interlocked with a throttle valve 63 of a carburetor via a linkage 62 so as to be closed upon light loading and opened upon heavy loading.

In this way, at the time of heavy loading when the piston opens the exhaust port at the end of the expansion stroke, combustion gas at a high temperature and a high pressure is caused to blow down to the outside of the cylinder, that is, to the muffler. During the subsequent exhaust stroke commencing with rise of the piston, the amount of combustion gas exhausted through the rotary valve at the top of the combustion chamber is relatively small. Therefore, a small thermal load is maintained on the rotary valve.

On the other hand, at the time of light loading, although the cylinder exhaust port 21 communicates with the inside of the cylinder at the end of the intake stroke, the exhaust throttle valve 60 will be closed so that a reverse flow of combustion gas from the muffler is prevented. Hence, an excessive EGR is eliminated and adverse effects within the cylinder, such as a misfire, can be prevented.

With this modification, good fuel combustion takes place in light load to heavy load conditions, and the resulting exhaust gas is clean.

Figure 4:
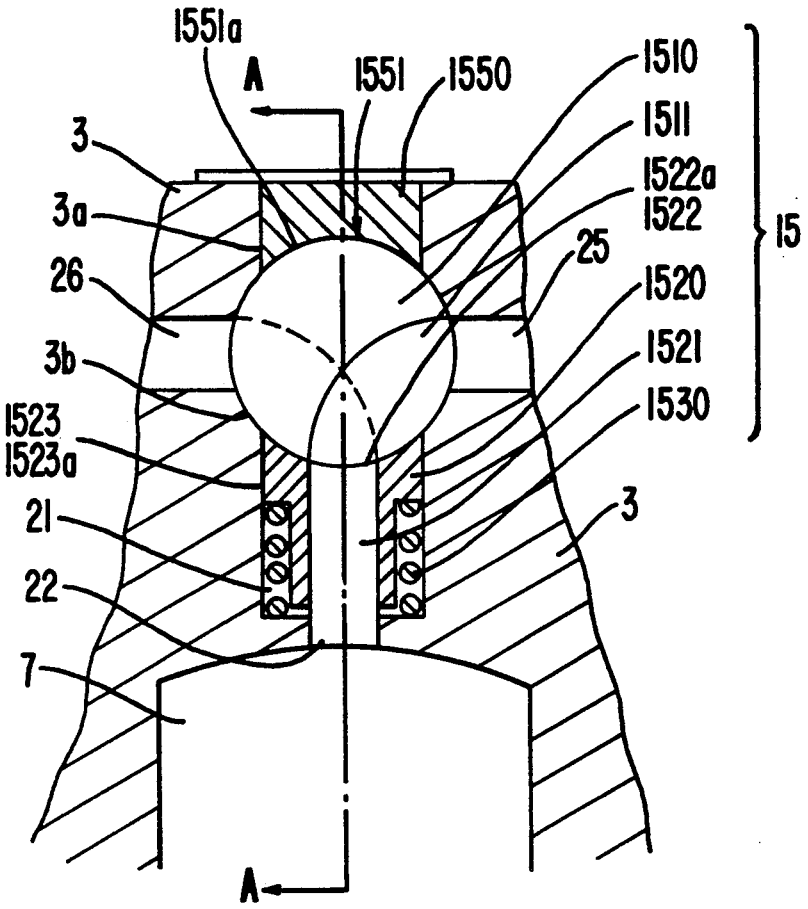
FIG. 4 is a cross-sectional view of an essential part of a rotary valve for use in the 4-cycle engine according to the present invention.
Figure 5:
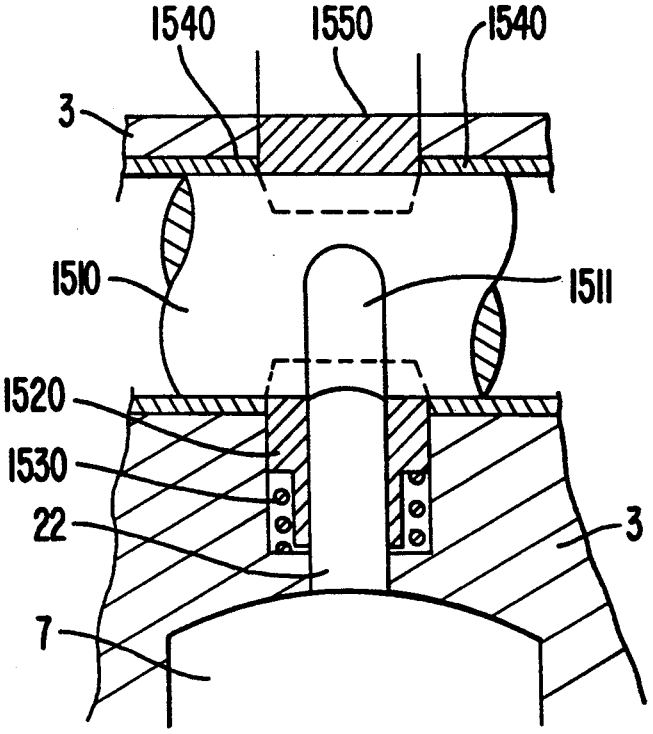
FIG. 5 is a cross-sectional view taken along line A—A in FIG. 4.

Now, one preferred embodiment of the rotary valve 15 will be described with reference to FIGS. 4 to 6.

The rotary valve 15 comprises a valve member 1510, a slide member 1520, a resilient member 1530, a bearing member 1540 and a blind cover 1550, which are disposed at the intersection of the communication passage 22, the intake passage 26 and the exhaust passage 25. Reference numeral **3*a* designates a slide member bore which extends from an outside surface on one side of the cylinder head 3 towards the combustion chamber 7 in a multi-stepped form. Reference numeral 3*b* designates a bearing member bore which is formed in the cylinder head at the intersection of the communication passage 22, the intake passage 26 and the exhaust passage 25. This bore 3*b* is formed perpendicularly to the slide member bore 3*a*. The slide member 1520 fits airtightly and slidably in the slide member bore 3*a* with the resilient member 1530 disposed toward the combustion chamber 7. The bearing member 1540 is fitted in the bearing member bore 3*b*, straddles the slide member bore 3*a*, and rotatably supports the valve member 1510**.

The valve member 1510 is a cylindrical member provided with a notch 1511 having a width in the axial direction of the cylindrical member and a nearly crescent-shaped cross section as taken perpendicular to the axial direction. The notch 1511 is provided at the intersection of the communication passage 22, the intake passage 26 and the exhaust passage 25 so as to be disposed at a position where it can oppose the communication passage 22, the intake passage 26 and the exhaust passage 25. The slide member 1520 has a cylindrical shape or a stepped cylindrical shape whose interior 1521 delimits the communication passage 22. In the case where it has a stepped cylindrical shape, its smaller diameter portion faces away from the valve member 10, and the end of its larger diameter portion defines a cylindrical slide surface 1522 held in contact with the cylindrical outer surface of the valve member 1510. In the case where the slide member 1520 has a stepped cylindrical shape, the resilient member 1530 is a coil spring extending around the outside of the smaller diameter portion. In the case where the slide member 1520 is simply cylindrical, the resilient member 1530 is either a belleville spring or a coil spring disposed in contact with the bottom end surface of the slide member 1520 so as to bias the slide member 1520 into contact with the valve member 1510. The outer cylindrical surface of the slide member 1520 is in sliding engagement with the surface defining the slide member bore 3a although clearance 1523a is maintained therebetween so that it can slide in the lengthwise direction of the communication passage 22.

The blind cover member 1550 is provided in the outer portion the slide member bore 3a. One end of the blind cover member 1550 defines a cylindrical surface 1551 conformed to the cylindrical surface of the valve member 1510, and it is in sliding engagement with the valve member 1510 with clearance 1551a maintained therebetween. The rotary valve 15 is coupled to the crankshaft 5 via a synchronizing drive mechanism described later on.

Now, the operation of the above-described preferred embodiment will be explained.

When the rotary valve 15 is rotated by the above-mentioned synchronizing drive mechanism, the notch 1511 in the valve member 1510 forms a passage which sequentially opens the intake passage 26 to the communication passage 22 and the communication passage 22 to the exhaust passage 25.

Figures 6A, 6B, 6C, 6D, 6E, 6F, 6G, 6H, 6I:
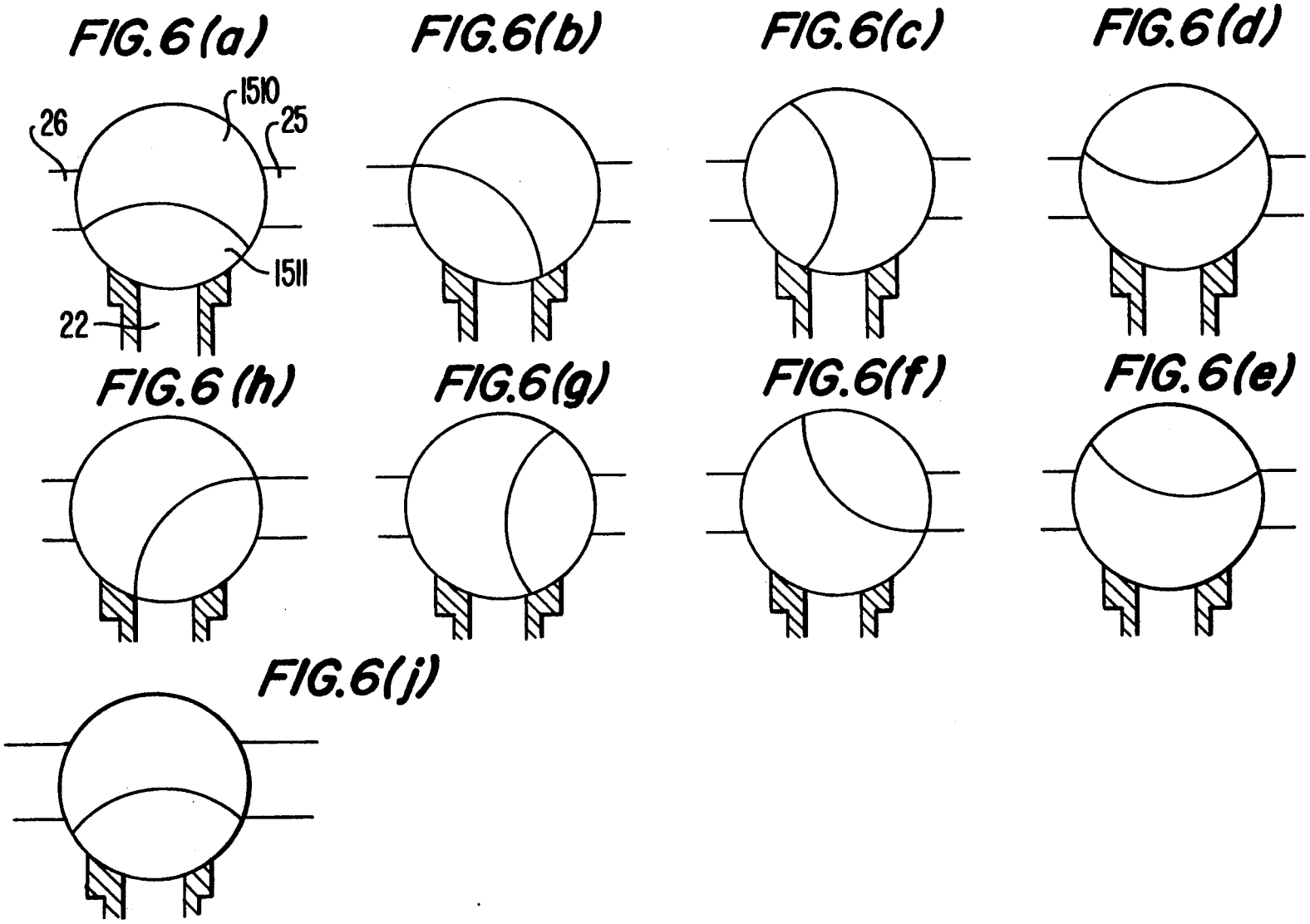
FIGS. 6(*a*)–6(*j*) ar schematic diagrams illustrating the timing of the rotary valve.

The timing of the rotary valve 15 is shown in FIG. 6. In this figure, the state just before the commencement of the intake stroke is shown in FIG. 6(*a*), a state between the commencement and end of the intake stroke is shown in FIG. 6(*b*), the state just after the end of the intake stroke is shown in FIG. 6(*c*), a state between the end of the intake stroke and the commencement of the exhaust stroke is shown in FIG. 6(*d*), another state between the end of the intake stroke and the commencement of the exhaust stroke is shown in FIG. 6(*e*), still another state between the end of the intake stroke and the commencement of the exhaust stroke is shown in FIG. 6(*f*), the state just before the commencement of the exhaust stroke is shown in FIG. 6(*g*), a state between the commencement of the exhaust stroke and the end of the exhaust stroke is shown in FIG. 6(*h*), and the state just after the end of the exhaust stroke is shown in FIG. 6(*j*). During the period between the state shown in FIG. 6(*c*) and the state shown in FIG. 6(*g*), the communication passage 22 is blocked. At least one of the intake passage 26 and the exhaust passage 25 is also blocked. During the period between the state shown in FIG. 6(*e*) and the state shown in FIG. 6(*g*), the intake gas confined within the notch 1511 is exhausted through the exhaust passage 25. Since during one revolution of the rotary valve 15 the combustion chamber 7 and intake passage 26 and the combustion chamber 7 and exhaust passage 25 are respectively once placed in communication before and after the combustion chamber 7 is blocked, the blocked period is allotted to the compression and expansion strokes, the period preceding this blocked period is allotted to the intake stroke and the period succeeding this blocked period is allotted to the exhaust stroke. Thus, the entire period corresponds to two revolutions of the crankshaft 5.

Therefore, if the ratio of revolutions of the crankshaft to the rotary valve effected by the synchronizing drive mechanism is 2:1, then the thermodynamic cycle within the combustion chamber 7 corresponds to one revolution of the rotary valve 15.

The pressure in the combustion chamber 7 also acts on the slide member 1520. Since the valve member 1510 is provided with the notch 1511, the surface area at one diametrical half thereof having the notch 1511 is different from that of the other diametrical half. In the compression and expansion strokes when the pressure in the combustion chamber 7 is high, the valve member 1510 contacts the slide member 1520 at its other diametrical half (that does not have the notch 1511). However, in the intake and exhaust strokes when the pressure in the combustion chamber 7 is low, the contact is effected at the one diametrical half of the valve member 1510 having the notch 1511. On the diametrical half without the notch 1511, the slide member 1520 contacts the cylindrical slide surface of the engaging members over a contact area equal to the cylindrical surface area, while on the one diametrical half having the notch 1511, the contact area is smaller by an amount corresponding to the area of the notch 1511. Because the force acting upon the slide member 1520 during the intake and exhaust strokes is principally the small resilient force exerted by the resilient member 1530, the load upon the contacting surfaces is small, whereby the oil film at the contacting surfaces is maintained.

In this way, airtightness of the combustion chamber 7 is ensured by the sealing effect of the oil film maintained in the space 1523a between the wall surface defining the slide member bore 3a and the cylindrical outer circumferential surface 1523 of the slide member 1520 and the sealing effect of the oil film maintained in the space 1522a between the cylindrical outer circumferential surface of the valve member 1510 and the cylindrical surface 1522 of the slide member 1520. As described above, the lubricant oil is fed to the slide surfaces in the intake fuel mixture flowing to the notch 1511.

Thus, despite having a simple construction, the rotary valve 15 can facilitate the intake of the fuel mixture and the exhaust of the combustion gas as well as ensure an airtight sealing of the combustion chamber.

Furthermore, the slide member 1520 can advantageously be made of a sintered metal having an oil-retaining property so that the oil film is well-maintained at the contact surfaces. The bearing member 1540 need not be formed as two divided halves but can be an integral metal cylindrical bearing having a diametrical through-hole aligned with the slide member bore 3b.

Next, the synchronizing drive mechanism for the rotary valve will be described with reference to FIGS. 7 and 8.

Figure 7:
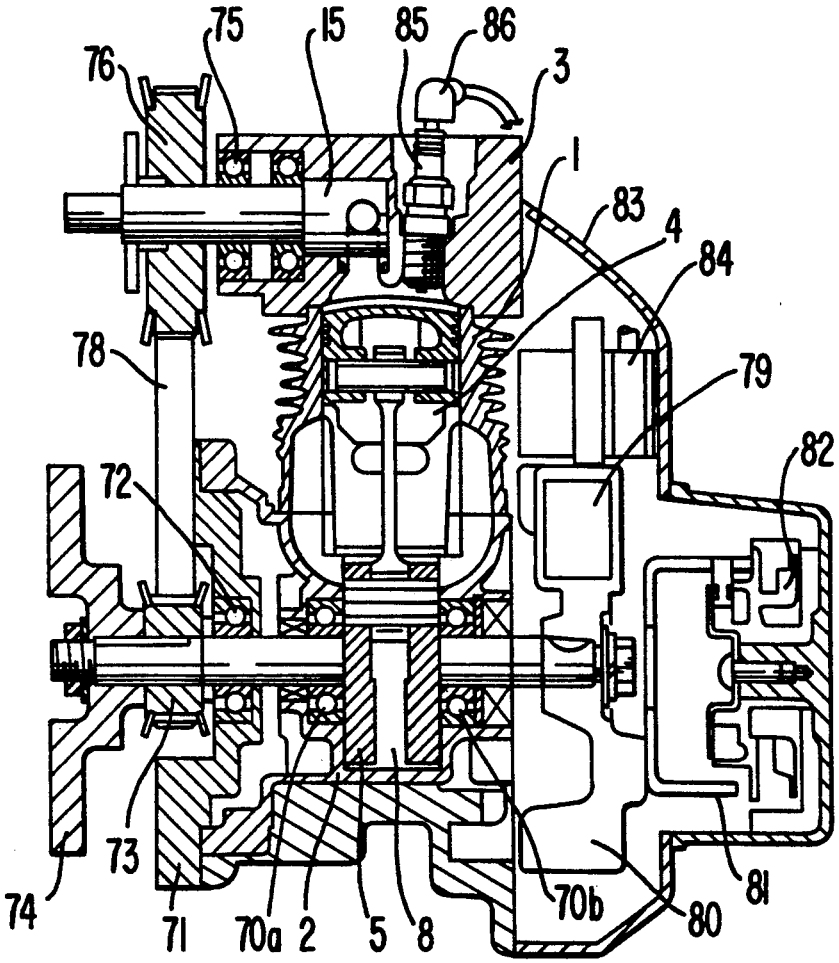
FIG. 7 is a schematic view of a first embodiment of a rotary valve synchronizing drive mechanism according to the present invention.

In the first preferred embodiment shown in FIG. 7, the piston 4 reciprocates within cylinder 1 as synchronized with the crankshaft 5 via the connecting rod. The crankshaft 5 is provided with main bearings 70a and 70b on its opposite sides, as enclosed by the crankcase 2 which forms the crankcase chamber 8. The crankshaft 5 extends leftwards from the crankcase chamber 8 in the figure. It is supported by the crankcase via a bearing 72 mounted to a bearing bracket 71. Further, a first pulley 73 and an output pulley 74 are mounted to the crankshaft 5 externally of the bearing 72.

In addition, within the cylinder head 3 is provided a bearing 75 for rotatably supporting a shaft of the rotary valve 15. The shaft of the rotary valve extends leftwards and supports a second pulley 76 thereon at a position opposed to the first pulley 73. A timing belt 78 extends between the first and second pulleys 73 and 76. A ratio of outer diameters of the first pulley 73 and the second pulley 76 is 1:2 such that the rotary valve will be opened and closed in synchronism with the movement of the piston 4. At an end portion of the crankshaft opposite the first pulley 73 are disposed a cooling fan and a flywheel 80 supporting magnets 79 so as to serve as a magnet ignition device. Further, a starting pulley 81 is mounted on the flywheel 80. A recoil starter 82 and a fan cover 83 are provided outside of the starting pulley 81.

A high voltage is generated in an ignition coil 84 from electric power produced by magnets 79 embedded within the flywheel 80. Sparks are discharged by an ignition plug 85 provided in a combustion chamber via a high-voltage cord 86.

Figure 8:
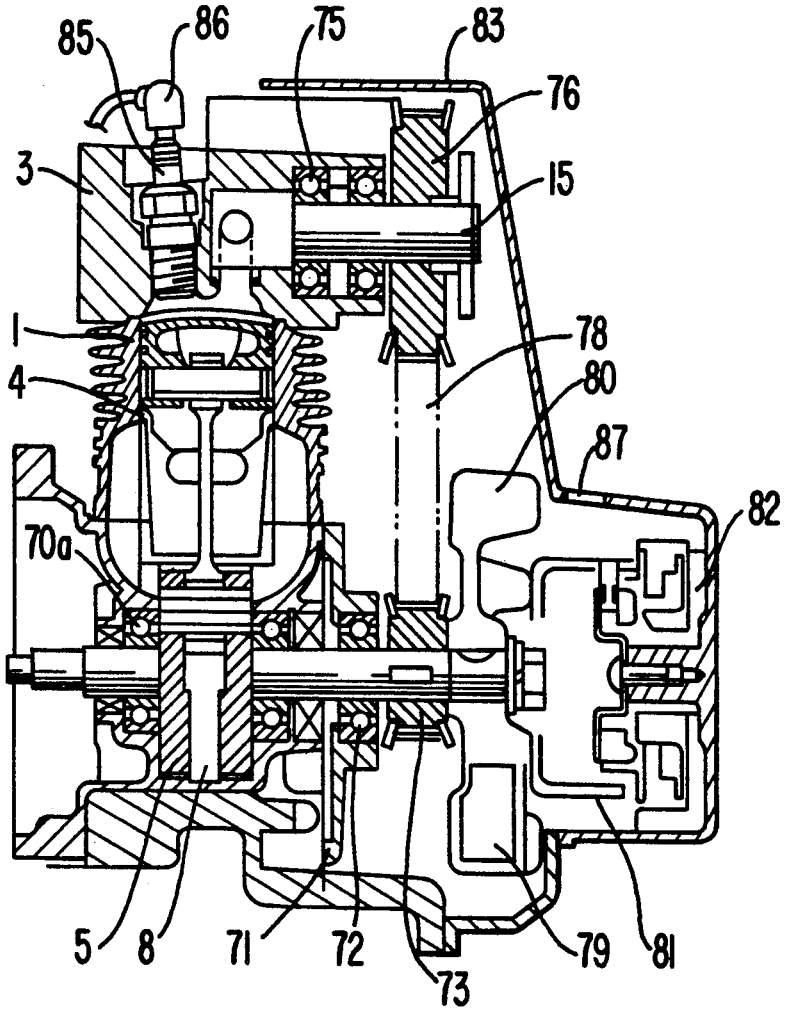
FIG. 8 is a schematic view of a second embodiment of a rotary valve synchronizing drive mechanism according to the present invention.
Figure 9:
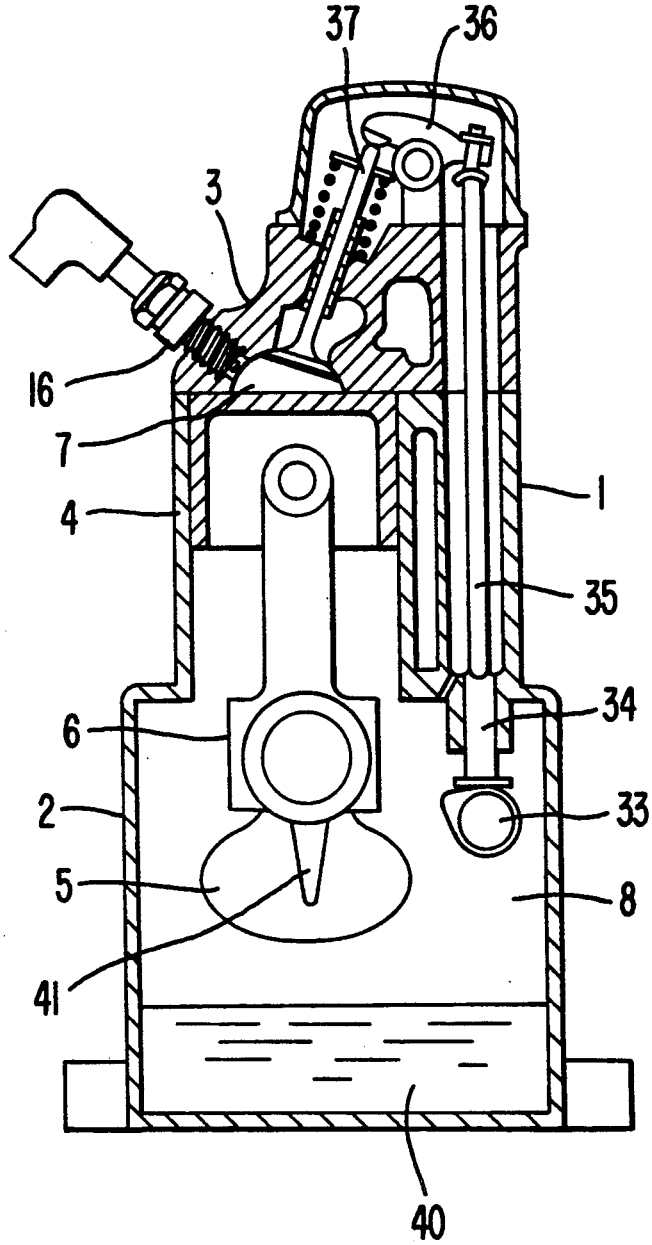
FIG. 9 (PRIOR ART)
FIG. 9 is a cross-sectional view of a 4-cycle engine in the prior art.

FIG. 8 shows a second preferred embodiment of the rotary valve drive mechanism in the 4-cycle engine according to the present invention. In this embodiment the crankshaft 5 extends in the rightward direction reversely to the first preferred embodiment shown in FIG. 7, and a first pulley 73 for driving the shaft of the rotary valve is provided externally of the crankcase. The rotary valve 15, piston, cylinder and cylinder head are similar to those shown in FIG. 7. A bearing bracket 71 and a bearing 72 are also provided externally of the crankcase. To the outside of these elements is disposed a first pulley 73.

In the embodiment shown in FIG. 8, to the outside of the first pulley 73 are mounted a cooling fan, a flywheel 80 serving also as a magnet ignition device, and a starting pulley 81. In this case, a flow of cold air is introduced from the side of the recoil starter 82. Further, cold air flow intake ports are provided on the outer circumference of the recoil starter 82.

Now, the operation of the above-described preferred embodiment will be described.

The shaft of the rotary valve is driven at a reduced speed ½ times that of the rotational speed of the crankshaft via the timing belt 78 provided externally of the crankcase. The rotary valve opens the communication passage at the top of the cylinder head 3 with the exhaust passage during the exhaust stroke of the piston and with the intake passage during the intake stroke of the piston.

Owing to the additional bearing 72 provided externally of the crankcase, even though a pulley is provided on an extended portion of the crankshaft, a bending stress applied to the extended portion of the crankshaft can be mitigated.

In addition, according to the present invention, because the rotary valve 15 is driven by the crankshaft via the timing belt 78 provided outside of the crankcase 2, the crankcase compression ratio can be preset at a high value.

Because the crankshaft is coupled to the shaft of the rotary valve within the cylinder head by means of a relatively simple structure, the engine can be lightweight and compact so as to be suitable for use in a hand-held machine. Furthermore, since the pulley is provided externally of the crankcase, it is easy to maintain the airtightness of the crankcase and the crankcase compression ratio can be preset at a high value.

While a principle of the present invention has been described above in connection with preferred embodiments of the invention, it is intended that all matter described in the specification and illustrated in the accompanying drawings be interpreted as illustrative of the invention and not in a limiting sense.

What is claimed is:

1. A 4-cycle internal combustion engine comprising: a crankcase, a cylinder integral with the crankcase, a cylinder head defining intake and exhaust passages therein and capping said cylinder, said intake passage communicating with the interior of said crankcase, a piston slidably fitted in said cylinder so as to be reciprocatable therewithin, said piston, cylinder and cylinder head delimiting a combustion chamber, a crankshaft extending within said crankcase and rotatably supported in the engine, a connecting rod connecting said piston and said crankshaft so as to limit the reciprocation of said piston between top and bottom dead center positions thereof, said cylinder having an exhaust port extending through a side wall of the cylinder and open to the interior of the cylinder at a location above the piston when the piston is in the bottom dead center position thereof, a rotary valve disposed between said intake and said exhaust passages and the combustion chamber, said rotary valve being operable to selectively place said passages in communication with said combustion chamber by opening said intake passage to the combustion chamber and opening said exhaust passage to the combustion chamber during one complete revolution of the valve, a synchronizing drive mechanism synchronizing said rotary valve with said crankshaft so as to rotate at a ratio of 1:2 with respect to the rotation of said crankshaft, so as to be in a rotary position which places said intake passage in open communication with the combustion chamber during the intake stroke of the piston, and so as to be in a rotary position which places the exhaust passage in open communication with the combustion chamber during the exhaust stroke of the piston, a check valve operatively interposed between said intake passage and the interior of said crankcase in communication therewith, said check valve allowing flow only in a direction toward said intake passage, and fuel feed means for introducing a mixture of air, fuel and lubricating oil to the interior of said crankcase, the mixture being aspirated into the crankcase and being fed from the interior of the crankcase to the intake passage by variations in pressure in the crankcase caused by the reciprocation of said piston.

2. A 4-cycle internal combustion engine as claimed in claim 1, and further comprising an intake chamber interposed between the intake passage and the interior of the crankcase in communication therewith.

3. A 4-cycle internal combustion engine as claimed in claim 2, wherein said intake chamber has a volume that is at least that of the volume displaced by said piston during the intake stroke thereof.

4. A 4-cycle internal combustion engine as claimed in claim 1, and further comprising a muffler interposed between and in communication with said exhaust passage and said exhaust port.

5. A 4-cycle internal combustion engine as claimed in claim 1, wherein said fuel feed means includes a carburetor throttle valve, and further comprising an exhaust throttle valve in said exhaust port, said exhaust throttle valve being interlocked with said carburetor throttle valve so as to be moved to a position which closes the exhaust port when the carburetor throttle valve is oriented at a small angle, the extent of which angle corresponds to the degree of opening of the carburetor throttle valve.

6. A 4-cycle internal combustion engine comprising: a crankcase, a cylinder integral with the crankcase, a cylinder head defining intersecting intake, exhaust and communication passages therein and a hole extending perpendicular to said passages at the intersection thereof, said cylinder head capping said cylinder, said intake passage communicating with the interior of said crankcase, a piston slidably fitted in said cylinder so as to be reciprocatable therewithin, said piston, cylinder and cylinder head delimiting a combustion chamber, the communication passage in said cylinder head open to said combustion chamber, a crankshaft extending within said crankcase and rotatably supported in the engine, a connecting rod connecting said piston and said crankshaft so as to limit the reciprocation of said piston between top and bottom dead center positions thereof, a rotary valve disposed at the intersection of said intake, exhaust and communication passages, said rotary valve including a cylindrical valve member fixed in said hole in the cylinder head, a tubular slide member disposed in said cylinder head between said valve member and said combustion chamber with the interior of the slide member delimiting said communication passage, said tubular slide member having a cylindrical surface at one end thereof disposed face-to-face with said cylindrical valve member, and a resilient member biasing said tubular slide member in its axial direction toward said cylindrical valve member, said cylindrical valve member having a notch therein having a nearly crescent-shaped cross section as taken in plane perpendicular to the axial direction thereof, said notch having such a length as taken in the circumferential direction of the cylindrical valve member as to be open to both the intake passage and the interior of said slide member when the valve member is in one rotary position and as to be open to both the exhaust passage and the interior of said slide member when the valve member is in another rotary position, a synchronizing drive mechanism synchronizing the cylindrical valve member of said rotary valve with said crankshaft to as to rotate at a ratio of 1:2 with respect to the rotation of said crankshaft, so as to be at said one rotary position during the intake stroke of the piston, and so as to be in said another rotary position during the exhaust stroke of the piston, a check valve operatively interposed between said intake passage and the interior of said crankcase in communication therewith, said check valve allowing flow only in a direction toward said intake passage, and fuel feed means for introducing a mixture of air, fuel and lubricating oil to the interior of said crankcase, the mixture being aspirated into the crankcase and being fed from the interior of the crankcase to the intake passage by variations in pressure in the crankcase caused by the reciprocation of said piston.

7. A 4-cycle internal engine as claimed in claim 6, wherein said slide member comprises a sintered metal having an oil-retaining property.

8. A 4-cycle internal combustion engine comprising: a crankcase, a cylinder integral with the crankcase, a cylinder head defining intake and exhaust passages therein and capping said cylinder, said intake passage communicating with the interior of said crankcase, a piston slidably fitted in said cylinder so as to be reciprocatable therewithin, said piston, cylinder and cylinder head delimiting a combustion chamber, a crankshaft extending through said crankcase and rotatably supported in the engine, said crankshaft including a crank within said crankcase and a shaft having one end projecting outwardly from said crankcase, a connecting rod connecting said piston and the crank of said crankshaft so as to limit the reciprocation of said piston between top and bottom dead center positions thereof, a rotary valve disposed between said intake and said exhaust passages and the combustion chamber, said rotary valve having a rotary valve shaft by which said valve is operated, said rotary valve being operable to selectively place said passages in communication with said combustion chamber by opening said intake passage to the combustion chamber and opening said exhaust passage to the combustion chamber during one compete revolution of the valve shaft, a synchronizing drive mechanism synchronizing said rotary valve with said crankshaft to as to rotate at a ratio of 1:2 with respect to the rotation of said crankshaft, so as to be in a rotary position which places said intake passage in open communication with the combustion chamber during the intake stroke of the piston, and so as to be in a rotary position which places the exhaust passage in open communication with the combustion chamber during the exhaust stroke of the piston, said synchronizing drive mechanism including a first pulley mounted on the end of said crankshaft disposed outwardly of said crankcase, a bearing rotatably supporting said end of the crankshaft disposed outwardly of said crankcase, a second pulley mounted to the valve shaft of said rotary valve, and a timing belt engaged with said pulleys, a check valve operatively interposed between said intake passage and the interior of said crankcase in communication therewith, said check valve allowing flow only in a direction toward said intake passage, and fuel feed means for introducing a mixture of air, fuel and lubricating oil to the interior of said crankcase, the mixture being aspirated into the crankcase and being fed from the interior of the crankcase to the intake passage by variations in pressure in the crankcase caused by the reciprocation of said piston.

9. A 4-cycle internal combustion engine as claimed in claim 8, and further comprising a bracket mounted to said crankcase, said bracket supporting said bearing.

10. A 4-cycle internal combustion engine as claimed in claim 8, and further comprising a fan cover covering said timing belt.

11. A 4-cycle internal combustion engine as claimed in claim 9, and further comprising a fan cover covering said timing belt.

12. A 4-cycle internal combustion engine comprising: a crankcase, a cylinder integral with the crankcase, a cylinder head defining intake and exhaust passages therein and capping said cylinder, said intake passage communicating with the interior of said crankcase, a piston slidably fitted in said cylinder so as to be reciprocatable therewithin, said piston, cylinder and cylinder head delimiting a combustion chamber, a crankshaft extending through said crankcase and rotatably supported in the engine, said crankshaft including a crank within said crankcase and a shaft having one end projecting outwardly from said crankcase, a connecting rod connecting said piston and the crank of said crankshaft so as to limit the reciprocation of said piston between top and bottom dead center positions thereof, a rotary valve disposed between said intake and said exhaust passages and the combustion chamber, said rotary valve having a rotary valve shaft by which said valve is operated, said rotary valve being operable to selectively place said passages in communication with said combustion chamber by opening said intake passage to the combustion chamber and opening said exhaust passage to the combustion chamber during one complete revolution of the valve, a synchronizing drive mechanism synchronizing said rotary valve with said crankshaft so as to rotate at a ratio of 1:2 with respect to the rotation of said crankshaft, so as to be in a rotary position which places said intake passage in open communication with the combustion chamber during the intake stroke of the piston, and so as to be in a rotary position which places the exhaust passage in open communication with the combustion chamber during the exhaust stroke of the piston, said synchronizing drive mechanism including a first pulley mounted on the end of said crankshaft disposed outwardly of said crankcase, a second pulley mounted to the valve shaft of said rotary valve, and a timing belt engaged with said pulleys, a fan cover covering said timing belt, a check valve operatively interposed between said intake passage and the interior of said crankcase in communication therewith, said check valve allowing flow only in a direction toward said intake passage, and fuel feed means for introducing a mixture of air, fuel and lubricating oil to the interior of said crankcase, the mixture being aspirated into the crankcase and being fed from the interior of the crankcase to the intake passage by variations in pressure in the crankcase caused by the reciprocation of said piston.

* * * * *